US007408444B2

(12) United States Patent
Dufosse et al.

(10) Patent No.: US 7,408,444 B2
(45) Date of Patent: Aug. 5, 2008

(54) SOUND-REPRODUCING TRANSDUCER

(75) Inventors: Stéphane Dufosse, Cormeilles En Parisis (FR); Jean-Christophe Villain, Ounans (FR); Eric Menu, Paris (FR); Yves Le Baudour, Franconville (FR)

(73) Assignee: T & A Mobile Phones Limited, Hong Kong (CN)

( * ) Notice: Subject to any disclaimer, the term of this patent is extended or adjusted under 35 U.S.C. 154(b) by 129 days.

(21) Appl. No.: 10/565,472

(22) PCT Filed: Jul. 19, 2004

(86) PCT No.: PCT/FR2004/001939

§ 371 (c)(1),
(2), (4) Date: Jan. 19, 2006

(87) PCT Pub. No.: WO2005/020623

PCT Pub. Date: Mar. 3, 2005

(65) Prior Publication Data

US 2006/0177070 A1 Aug. 10, 2006

(30) Foreign Application Priority Data

Jul. 25, 2003 (FR) ..... 03 09112

(51) Int. Cl.
*G08B 3/00* (2006.01)

(52) U.S. Cl. ..... 340/388.1; 340/384.1

(58) Field of Classification Search ..... 340/388.1, 340/384.1, 391.1

See application file for complete search history.

(56) References Cited

U.S. PATENT DOCUMENTS 4,376,233 A * 3/1983 Kamon et al. ..... 381/409

(Continued)

FOREIGN PATENT DOCUMENTS

EP 2001231088 2/2000

(Continued)

OTHER PUBLICATIONS

International Search Report—Sep. 16, 2006.

*Primary Examiner*—Jeff Hofsass
*Assistant Examiner*—Kerri L McNally
(74) *Attorney, Agent, or Firm*—Morgan, Lewis & Bockius LLP

(57) ABSTRACT

The invention relates to a sound-reproducing transducer (60) connected to a printed circuit (50). This transducer (60) has the shape of a hollow cylinder whose cylindrical wall (66) delimits two circular faces, one front face (66*c*) and one rear face (66*d*) that are opposed and planar. The transducer (60) comprises at least one diaphragm (64) that makes it possible to convert electric signals into sound waves and conversely. This diaphragm (64) is a circular membrane parallel to the front face (66*c*) and rear face (66*d*) of the transducer (60). The diaphragm (64) delimits two distinct volumes in the transducer (60), the first volume being bordered on one side by the circular face (66*c*) of the transducer (60) and on the other by the diaphragm (64) while forming a front acoustic cavity (61), and the second volume being bordered on one side by the circular face (66*d*) of the transducer (60) and on the other by the diaphragm (64) while forming a rear acoustic cavity (62). The invention is characterized in that the cylindrical wall (66) of the transducer (60) has at least one perforation (72, 74, 76, 77, 78).

4 Claims, 2 Drawing Sheets

U.S. PATENT DOCUMENTS 4,443,667 A * 4/1984 Hunt ..... 381/418
4,504,703 A * 3/1985 Schneiter et al. ..... 381/163
6,385,328 B1 * 5/2002 Yoo et al. ..... 381/412
6,466,682 B2 10/2002 An
6,810,128 B2 * 10/2004 Kaneda et al. ..... 381/396
7,194,284 B2 * 3/2007 Rousu ..... 455/553.1
2002/0101333 A1 * 8/2002 Lu ..... 340/384.1

FOREIGN PATENT DOCUMENTS

EP 1079662 5/2000
EP 2002165291 11/2000

* cited by examiner

SOUND-REPRODUCING TRANSDUCER

RELATED APPLICATIONS

The present application is a national phase application of PCT/FR2004/001939, which in turn claims the benefit of priority from French Patent Application No. 03 09 112, filed on Jul. 25, 2003, the entirety of which are incorporated herein by reference.

FIELD OF THE INVENTION

The present invention relates to a sound-reproducing transducer connected to a printed circuit, and to a terminal comprising this kind of transducer.

One non-exclusive field of application of the invention is that of mobile radiocommunication terminals.

BACKGROUND OF THE INVENTION

Manufacturers of mobile communication terminals are currently seeking to miniaturize them as much as possible whilst preserving optimum functional ergonomics.

This optimization of the size of the terminals, of which FIG. 1 is a diagrammatic side view, has impelled manufacturers to reduce their thickness.

A mobile terminal comprises a casing 10 in which are disposed various components such as a battery 20, a keypad 30, a screen 40 and a sound-reproducing transducer 60 connected to a printed circuit 50.

The sound-reproducing transducer or sound transducer 60 is adapted to transform electrical signals supplied to it into sound waves and vice-versa.

The sound transducer 60 may fulfill a plurality of functions such as those of earpiece, loudspeaker, ringer and vibrator.

The earpiece is essentially intended to be placed against the ear of a user when using the device to communicate, the ringer is used to alert the user to an incoming call or any other action, the loudspeaker enables sound reproduction at high volume for hands-free or ringer applications, for example, and the vibrator is used to alert the user discreetly to an incoming call through vibration of the earpiece.

To reproduce the sound waves, the sound transducer 60 consists of two distinct volumes defining a front acoustic cavity 61 and a rear acoustic cavity 62 the shapes and dimensions whereof must be adapted to allow sound reproduction of sufficient quality for the application for which the transducer is intended.

This sound reproduction is obtained by virtue of vibrations of a diaphragm that will be precisely defined hereinafter in the description of FIG. 3.

Moreover, the earpiece function necessitates a smaller component size than that required for a loudspeaker and ringer function which must emit sound at a greater volume. The volume occupied by the sound transducer 60 may not therefore be reduced beyond a certain limit imposed by the loudspeaker function.

Now, the current trend is to reduce the size and in particular the thickness of terminals.

Accordingly, the rear acoustic cavity 62 of the sound transducer 60 of current terminals has a volume of insufficient size and the space between the rear face of the transducer and the printed circuit is too small to allow sound reproduction of sufficient quality.

Inopportune damping of vibrations in the diaphragm of the sound transducer 60 occurs if the space between the rear face of the transducer and the printed circuit is less than 1 mm thick.

Those vibrations generating the sound, this leads to insufficient quality of sound reproduction.

OBJECTS AND SUMMARY OF THE INVENTION

An object of the invention is to propose a sound transducer having sound reproduction of satisfactory quality even though its rear face is very close to another component of the terminal.

To this end, the invention provides a sound-reproducing transducer connected to a printed circuit, the transducer having the shape of a hollow cylinder whose cylindrical wall delimits two circular faces: a front face and a rear face that are opposed and planar, the transducer comprising at least one diaphragm for converting electrical signals into sound waves and vice-versa, the diaphragm being a circular membrane parallel to the front face and the rear face of the transducer, the diaphragm delimiting two distinct volumes in the transducer:

the first volume, bordered on one side by the circular face of the transducer and on the other side by the diaphragm, this first volume forming a front acoustic cavity, and the second volume, bordered on one side by the circular face of the transducer and on the other side by the diaphragm, this second volume forming a rear acoustic cavity, characterized in that said cylindrical wall of the transducer includes at least one perforation.

The invention therefore facilitates the flow of air to the rear of the sound transducer and thereby enables acoustically satisfactory use of the transducer.

In one particular embodiment, the perforation forms a hole in the rear acoustic cavity of the transducer.

In one particular embodiment, said circular face of the transducer has at least one perforation.

Another aspect of the invention also provides a radiocommunication terminal comprising a sound-reproducing transducer as just defined.

BRIEF DESCRIPTION OF THE DRAWINGS

Other features and advantages of the invention will become apparent on reading the following description of one particular embodiment of the invention, which is given by way of illustrative and nonlimiting example, and examining the appended drawings.

DETAILED DESCRIPTION

In the remainder of the description, the invention is described in its application to radiotelephones or mobile telephones.

It applies more generally to all types of radio transceivers, for example a radio pager, a personal digital assistant (PDA) or a laptop computer.

Figure 2:
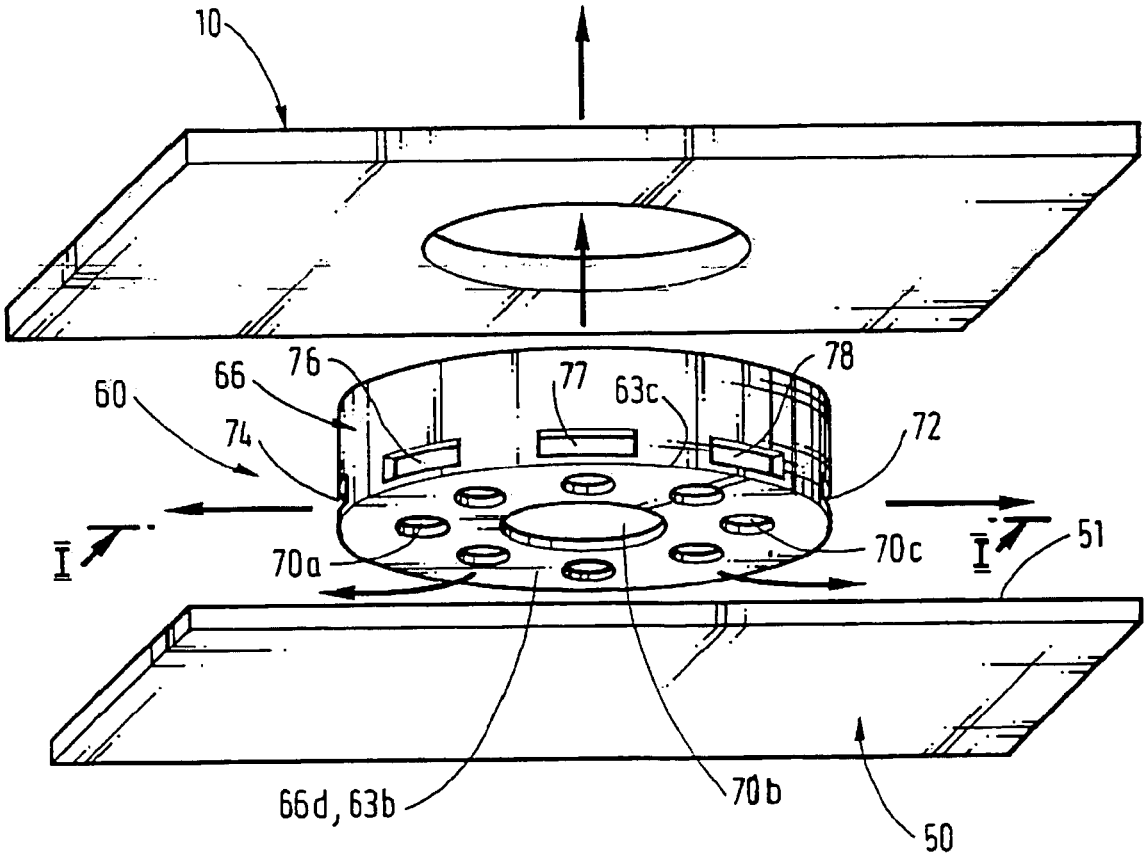
FIG. 2 is an exploded three-dimensional view of the sound transducer of the invention included between the printed circuit and the casing of the terminal.

Referring to FIG. 2, the general shape of the transducer 60 is that of a hollow cylinder the exterior cylindrical wall 66 whereof is delimited by two opposite circular faces: a front face 66*c* and a rear face 66*d*, both of which are substantially plane.

These faces 66*c*, 66*d* are substantially parallel to each other.

The front circular face 66*c* constitutes the front face 63*a* of the transducer 60. The rear circular face 66*d* constitutes the rear face 63*b* of the transducer 60.

The diaphragm 64 of the transducer 60, which is defined more precisely hereinafter, is situated between the front circular face 66*c* and the rear circular face 66*d* and is substantially parallel to them, at approximately half the height of the exterior wall of the transducer 60.

To enable the transducer 60 to function, its diaphragm 64 must be able to vibrate, and so air must be able to circulate between the transducer 60 and the casing 10 of the terminal.

To this end, the rear acoustic cavity 62 defined between the rear circular face 66*d* and the diaphragm 64 usually has perforations 70*a*, 70*b*, 70*c* situated on the rear face 66*d*.

These perforations 70*a*, 70*b*, 70*c* may be of diverse shapes and sizes.

For example, a substantially round perforation 70*b* is situated at the center of the rear circular face 66*d* and its radius is approximately one third of the radius of the rear circular face 66*d*.

Substantially round perforations 70*a* and 70*c* are situated toward the periphery of the circular face 66*d* and their radius is approximately one tenth of the radius of the circular face 66*d*.

Accordingly, air can escape through these perforations to the rear of the transducer 60.

However, because of terminal miniaturization constraints, the sound transducer has a rear acoustic cavity 62 of very small volume and the rear circular face 66*d* of the transducer is located too close to the front face 51 of the printed circuit 50.

The transducer 60 of the invention has an apertured cylindrical wall 69*a*, 69*b*.

Thus the cylindrical wall 69*a*, 69*b* of the transducer 60 comprises perforations 72, 74, 76, 77, 78.

The presence of these perforations 72, 74, 76, 77, 78 increases the flow of air at the exit from the transducer 60 and encourages effective circulation of the sound waves.

In one particular embodiment, the perforations 72, 74, 76, 77, 78 are of substantially rectangular shape.

Their size is approximately one third of the height of the cylindrical wall 69*a*, 69*b*.

The substantially rectangular perforations 72, 74, 76, 77, 78 are situated close to the junction between the cylindrical wall 66 and the front circular face 66*c*, at a distance of approximately one twentieth of the height of the cylindrical wall 66 from the front circular face 66*c*.

These rectangular perforations 72, 74, 76, 77, 78 situated close to the junction between the cylindrical wall 66 and the front circular face 66*c* increase the efficiency of the transducer 60 by approximately 50% compared to a transducer that does not have these perforations.

Figure 1:
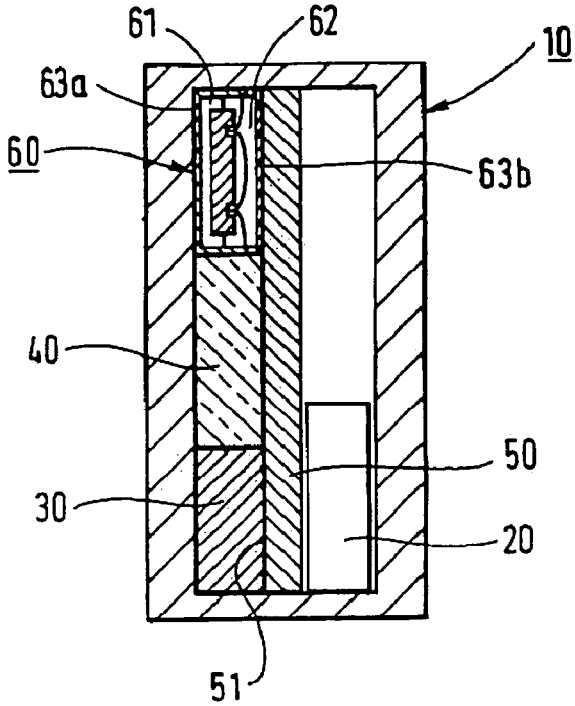
FIG. 1, already described, is a diagrammatic view in cross section of a radio communication terminal showing its main components.
Figure 3:
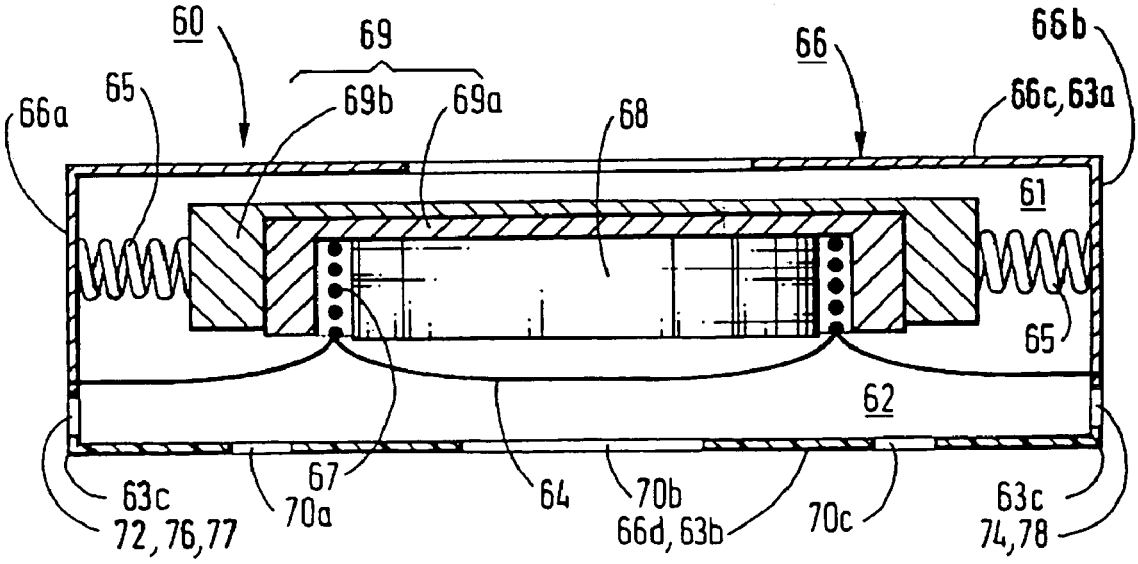
FIG. 3 shows a sound transducer in longitudinal section taken along the line I-I in FIG. 2.

Referring to FIG. 3, a transducer 60 conventionally includes a diaphragm 64 delimiting two cavities in the transducer 60: a front cavity 61 and a rear cavity 62, a coil 67, a magnet 68, and a metal support 69, such as a yoke, comprising a magnetic circuit 69*a* and a weight 69*b*.

The coil 67, the magnet 68 and the metal support 69 are situated in the front cavity 61 and therefore between the diaphragm 64 and the front circular face 66*c* of the transducer 60.

The transducer 60 consists of two portions, an electrically neutral first portion including the diaphragm 64 and the cylindrical wall 66, which are made from dielectric materials such as plastics materials, for example, and an electrically conductive second portion including the coil 67, the magnet 68 and the metal support 69, which are made of conductive materials.

The front acoustic cavity 7 is bordered on one side by the front circular face 66*c* of the transducer 60 and on the other side by the diaphragm 64.

The rear acoustic cavity 62 is bordered on one side by the rear circular face 66*d* of the transducer 60 and on the other side by the diaphragm 64.

The diaphragm 64 is a substantially circular membrane parallel to the front and rear circular faces 66*c* and 66*d*.

The diaphragm 64 is fixed to the inside face of the cylindrical wall 66 along the whole of its perimeter.

The diaphragm 64 is fixed to the coil 67 along the whole of the inside perimeter of the coil 67.

The diaphragm 64 has its center substantially in the middle of the generatrix of the transducer 60.

The coil 67 is substantially the shape of a hollow cylinder composed of two substantially circular disks and a cylindrical wall. This is known in the art.

Its generatrix is situated on the generatrix of the cylindrical transducer 60 and its center substantially in the middle of the generatrix of the transducer 60.

Its disks are substantially parallel to the circular faces 66*c* and 66*d*.

Its radius is approximately half the radius of one of the circular faces 66*c* or 66*d*.

The coil 67 is fixed to the magnetic circuit 69*a* along the whole of the perimeter of one of its disks and the other disk is fixed to the diaphragm 64.

The magnet 68 is substantially in the shape of a solid cylinder. This is known in the art.

Its circular faces are substantially parallel to the circular faces 66*c* or 66*d*.

Its generatrix is situated on the generatrix of the cylindrical transducer 60 and its center is substantially in the middle of the generatrix of the transducer 60.

Its radius is slightly less than the radius of the coil 67.

One of the circular faces of the magnet 68 is fixed to the magnetic circuit 69*a*.

The magnet 68 and the coil 67 are recessed into the magnetic circuit 69*a*.

The magnetic circuit 69*a* has the general shape of a hollow cylinder with a wide rim made up of a substantially circular face and a ring parallel to the circular face and a thick cylindrical wall. All this is known in the art.

Its circular face and its ring are substantially parallel to the circular faces 66*c* and 66*d* of the transducer 60.

Its generatrix is situated on the generatrix of the cylindrical transducer 60 and its center is substantially in the middle of the generatrix of the transducer 60.

Its radius is slightly greater than that of the coil 67.

The weight 69*b* is of substantially the same shape as the magnetic circuit 69*a* and the magnetic circuit 69 is recessed into the weight 69*b*. This is known in the art.

Its radius is slightly greater than that of the magnetic circuit 69*a*.

Its cylindrical wall is fixed by suspension members 65 to the cylindrical wall 66 of the transducer 60.

The suspension members 65 are fixed, firstly, to the middle of the cylindrical wall of the metal support 69 and perpendicularly to the latter and, secondly, perpendicularly to the external face of the cylindrical wall 66 of the transducer 60. All this is known in the art.

The suspension members 65 are springs, for example, extending parallel to the circular faces 66*c* and 66*d* of the transducer 60.

The suspension members 65 connected to the weight 69*b* form a suspension-weight system that is caused to vibrate when the coil 67 is excited by an electrical current.

The invention therefore enables acoustically satisfactory use of the transducer 60 under critical conditions in respect of the space between the various components of the radiocommunication terminal.

The invention claimed is:

1. Sound-reproducing transducer connected to a printed circuit, the transducer having the shape of a hollow cylinder whose cylindrical wall delimits two circular faces: a front face and a rear face that are opposed and planar, the transducer comprising:

at least one diaphragm for converting electrical signals into sound waves and vice-versa, the diaphragm being a circular membrane parallel to the front face and the rear face of the transducer, the diaphragm delimiting two distinct volumes in the transducer:

the first volume, bordered on one side by the circular face of the transducer and on the other side by the diaphragm, this first volume forming a front acoustic cavity, and the second volume, bordered on one side by the circular face of the transducer and on the other side by the diaphragm, this second volume forming a rear acoustic cavity, wherein said cylindrical wall of the transducer includes at least one perforation, wherein said perforation is of substantially rectangular shape.

2. Sound-reproducing transducer according to claim 1, wherein the perforation forms a hole in the rear acoustic cavity on the cylindrical wall of the transducer.

3. Sound-reproducing transducer according to claim 1, wherein said circular face of the transducer includes at least one perforation.

4. Sound-reproducing transducer according to claim 1, wherein said perforation has a size approximately one third of the height of the cylindrical wall.

* * * * *